United States Patent [19]

Azam et al.

[11] Patent Number: 4,760,590

[45] Date of Patent: Jul. 26, 1988

[54] MULTIOPERATION ACCELERATOR

[75] Inventors: Guy Azam, La Celle St. Cloud; François Dugardin, Paris; Jacques Milcamps, Clamart, all of France

[73] Assignee: C.G.R. MeV, Buc, France

[21] Appl. No.: 110,576

[22] Filed: Oct. 14, 1987

Related U.S. Application Data

[63] Continuation of Ser. No. 910,259, Sep. 19, 1986, abandoned, which is a continuation of Ser. No. 690,984, Jan. 14, 1985, abandoned.

[30] Foreign Application Priority Data

Jan. 17, 1984 [FR] France ..... 84 00662

[51] Int. Cl.[4] ..... G21K 3/00

[52] U.S. Cl. ..... 378/157; 378/159; 250/503.1

[58] Field of Search ..... 250/493, 503.1, 505.1, 250/399, 400; 378/157, 158, 159, 124

[56] References Cited

U.S. PATENT DOCUMENTS

| | | | |
|---|---|---|---|
| 3,329,847 | 7/1967 | Friedman | 378/124 |
| 3,919,548 | 11/1975 | Porter | 378/157 |
| 3,976,889 | 8/1976 | Noske et al. | 378/157 |
| 4,048,496 | 9/1977 | Albert | 378/124 |
| 4,095,114 | 6/1978 | Taumann . | |
| 4,181,858 | 1/1980 | Moore | 378/159 |
| 4,300,055 | 11/1981 | Taumann | 378/159 |
| 4,400,827 | 8/1983 | Spears | 378/159 |

FOREIGN PATENT DOCUMENTS

| | | |
|---|---|---|
| 0021441 | 1/1981 | European Pat. Off. . |
| 1593516 | 6/1970 | France . |
| 2243672 | 4/1975 | France . |

*Primary Examiner*—Bruce C. Anderson

*Attorney, Agent, or Firm*—Oblon, Fisher, Spivak, McClelland & Maier

[57] ABSTRACT

A multioperation accelerator simulating more especially cobalt radiation. According to the invention, an electron accelerator of average energy and a set of targets and filters are provided so as to obtain at least one penetration curve similar to that of cobalt and other closely related curves.

14 Claims, 2 Drawing Sheets

MULTIOPERATION ACCELERATOR

This application is a continuation of application Ser. No. 06/910,259, filed on Sept. 19, 1986, now abandoned which was a continuation of Ser. No. 06/690,984, filed on Jan. 14, 1985, now abandoned.

BACKGROUND OF THE INVENTION

1. Field of the Invention

The invention relates to a multioperation accelerator of simple design, usable more particularly in radiotherapy for treatments using low or average amounts of energy.

2. Description of the Prior art

In radiotherapy a distinction is made, among others, of two types of equipment, the radiation generators using radioactive sources, such for example as cobalt, and the particle (particularly electron) accelerators. These latter offer a great flexibility of use and allow high energies to be reached up to 40 MeV electrons and 25 MeV photons. However, such apparatus are costly. Particularly, the systems for adjusting and varying the power of the beam (so as to obtain the different operating conditions) acting on the acceleration parameters, particularly the HF power, have a great influence on the cost price of the installation.

Furthermore, the cobalt generator has its own particular qualities which means that it is very greatly appreciated by doctors although handling of the radioactive sources requires precautions. The radiation of the cobalt is a photon radiation which is very penetrating despite a low energy (1.3 MeV photons) since 50% of the maximum dose is still available at a depth of 12 cm in the tissue. On the other hand, the "skin dose" is relatively high which means, in certain cases, surface irradiation which is too high with consequent risks of burning.

Now, at the present time, it is possible to construct accelerator structures capable of supplying the electron energy (about 4 MeV) required for obtaining 1.3 MeV photons as with cobalt, and this for a relatively low cost price.

SUMMARY OF THE INVENTION

One of the aims of the invention consists then in perfecting a radiotherapy unit using a photon beam produced from an accelerator but whose characteristics are fairly close to those of cobalt with however additional facilities and particularly that of being able to use several types of beam. For example, a beam may be required having the same characteristics as cobalt radiation and also other beams having closely related characteristics, in particular improved characteristics in so far as the problem of the "skin dose" is concerned.

Another aim of the invention is to provide a system of low cost price, of the same order of size as a cobalt generator.

According to the general principle of the invention, the power of the accelerator remains constant (thus saving on the systems for adjusting the high frequency wave) whereas variations in operating conditions and characteristics of the beam are obtained by switching targets and/or filters at the output of the accelerator.

More precisely, the invention provides a multioperation accelerator of the particle beam type comprising a target bombarded by said particle beam so as to generate a photon beam, wherein the HF power for supplying said accelerator is fixed at a predetermined level and it comprises several switchable targets and/or filters at the output of said accelerator, allowing a predetermined number of target-filter combinations to which correspond as many photon beams with different chosen characteristics.

BRIEF DESCRIPTION OF THE DRAWINGS

The invention will be better understood and other advantages thereof will appear from the following description of several embodiments of a multioperation accelerator in accordance with its principle, given solely by way of example with reference to the accompanying drawings in which.

DESCRIPTION OF THE PREFERRED EMBODIMENTS

Figure 1:
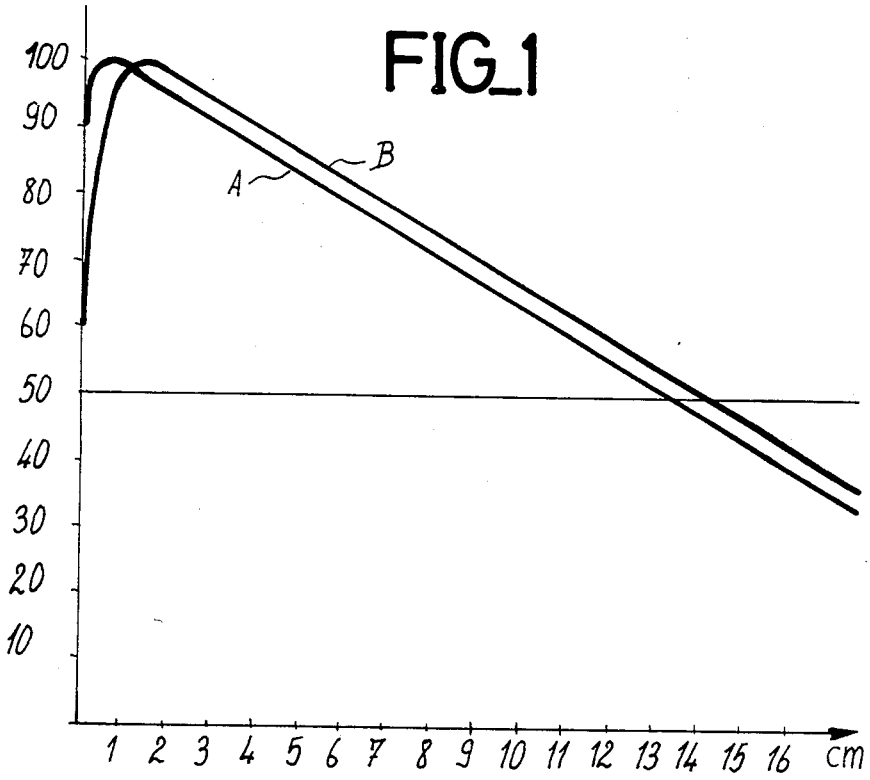
FIG. 1 is a graph showing a characteristic penetration curve of cobalt radiation but obtained by other means in accordance with the invention, as well as a curve closely related to that of cobalt improving the treatment conditions in some cases and also obtained by the means of the invention.

In the graph shown in FIG. 1, curve A is characteristic of cobalt. The depth of the tissue to be treated has been plotted (in centimeters) as abscissa and the radiation dose has been plotted as ordinates, standardized to 100 with respect to the maximum radiation. The main characteristics of this cobalt type radiation can be clearly seen:

maximum dose at 5 mm;

skin dose 85%;

depth reached with 50% of the maximum dose; 12 cm.

Such characteristics are interesting for they corresond to certain pathological situations where a tumour is essentially located in depth while having ramifications in the surface tissues.

In other cases, however, where the tumour is for example better localized in depth, the practitioner will rather choose a curve of type B, very similar to the cobalt curve but with a skin dose reduced by about half.

The invention provides this possibility, by means of a particle (electron, in the example) accelerator simplified by the fact that the HF supply power is fixed therein once and for all at a predetermined level (all the conventional power adjustment electronic systems, generally acting on the modulator, are no longer needed) and a set of switchable targets and/or filters at the output of said accelerator for choosing a characteristic of the beam in accordance with a type A or B curve, using simple mechanical selectors supporting the targets and/or filters.

Thus a target-filter combination may be provided restoring the radiation curve A and one or more other combinations restoring one or more type B curves, more or less "staggered in depth" and all having the advantage of a relatively low skin dose.

Figure 2:
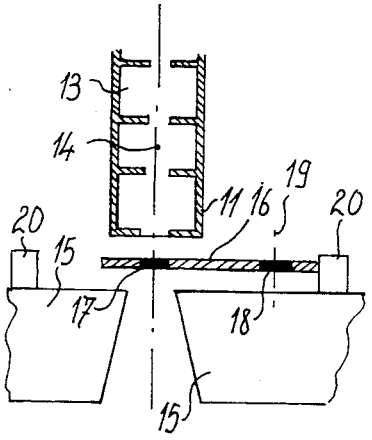
FIG. 2 illustrates a first embodiment of an accelerator in accordance with the invention.

In FIG. 2 the end part has been shown of an average power electron accelerator 11 (of about 4.5 MeV electrons). This accelerator is of quite conventional design and this is why it has not been described in detail. It may be formed for example by a modulator driving a magnetron, which is coupled by a wave guide to a cavity stack 13 forming a linear accelerating structure. This accelerator comprises a main axis 14 which also represents the path of the accelerated electrons. On leaving the accelerator, the electron beam bombards a target, which generates a photon beam. This latter is defined by a collimator 15.

Figure 3:
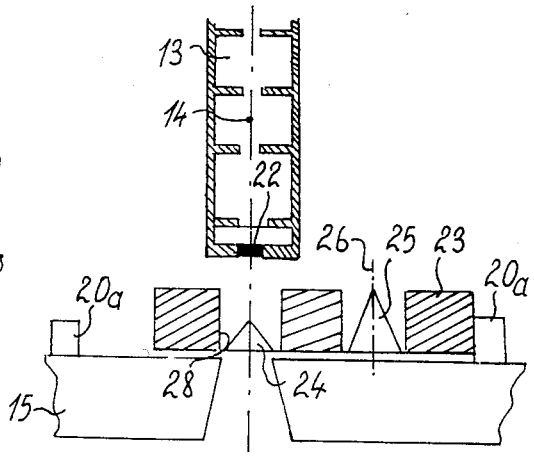
FIG. 3 illustrates the second embodiment of an accelerator in accordance with the invention.

In a first embodiment of the invention, the accelerator comprises a mobile support 16 comprising several targets 17, 18 each with a main axis of symmetry 19. The path of support 16 passes in front of the output of the accelerator and positioning means, shown schematically for example by two stops 20 between which support 16 may move, are provided for aligning any axis 19 with the main axis 14 of the accelerator. In this system, the characteristics of the photon beam conforming to a curve A or B are entirely determined by the choice of the material forming the target and the dimensional characteristics thereof. In the embodiments shown in FIG. 3, where similar structure elements bear the same reference numbers, a single target 22 has been provided disposed at the output of accelerator 11 and centered on its main axis 14. Furthermore, a mobile support 23 comprises several filters 24, 25 each having a main axis of symmetry 26.

As before, the path of support 23 passes in front of the target and in the vicinity thereof whereas positioning means (20*a* in the example) are provided for aligning the axis 26 of any filter with the main axis 14 of the accelerator. The filters 24, 25 have a dual role. On the one hand, they allow the spectral components of the photon beam to be fashioned, by attenuating them differently. They have then an energy filtering function which determines a curve of type A or B since the nature of the target is fixed a priori. Furthermore, they have an equalizing function because of their form, allowing directional attenuation of the beam so as to obtain the uniform distribution of the dose at the level of the patient. In fact it is known that in an accelerator the strength of the beam decreases the further away from axis 14. Consequently, in a way known per se, filters 24 and 25 will have a pyramidal shape preferably substantially conical. In the example shown in FIG. 3, support 23 is made essentially from lead. It comprises cavities 28 housing the conical shaped filters.

Figure 4:
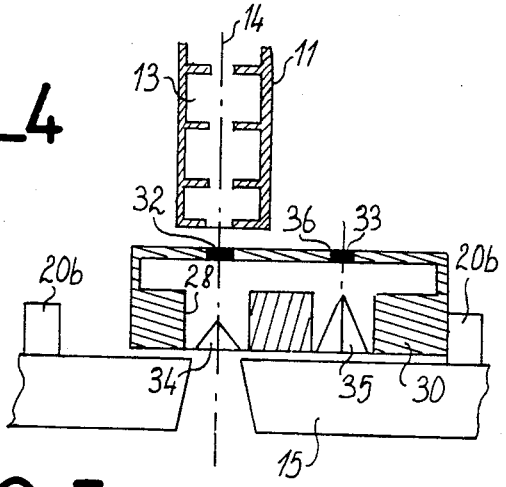
FIG. 4 illustrates a third embodiment of an accelerator in accordance with the invention.

The embodiment shown in FIG. 4, in which elements of similar structure bear the same reference numbers comprises a support 30 having several targets 32, 33 and several filters 34, 35. Support 30 is caused to move opposite the output of accelerator 11. It is essentially made from lead and comprises two stages. The upper stage (the closest to the accelerator) is pierced with holes 36 housing the targets 32 and 33 whereas the lower stage comprises, as in the case of FIG. 3, cavities 28 housing the filters 34 and 35. The holes and cavities are such that the main axis of symmetry of target 32 merges with the main axis of symmetry of filter 34 and so that the main axis of symmetry of target 33 merges with the main axis of symmetry of filter 35. Furthermore, as before, positioning means (stops 20B) are provided for immobilizing support 30 in positions such that any of the axes common to the targets and filters may be aligned with the main axis 14 of the accelerator.

Figure 5:
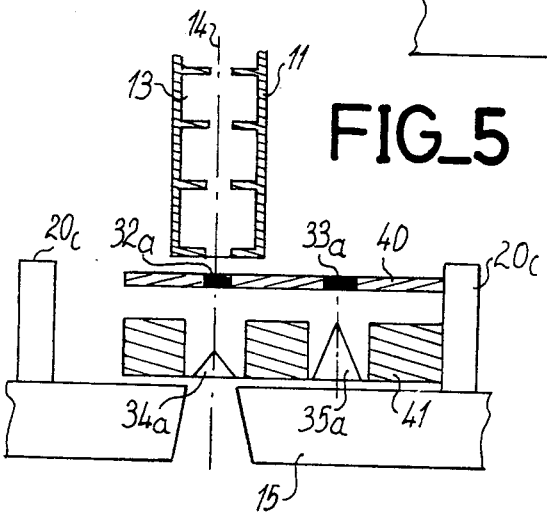
FIG. 5 illustrates a fourth embodiment of an accelerator in accordance with the invention.

The embodiment shown in FIG. 5 is only distinguished from the preceding one in that it comprises two independent supports 40, 41. Support 40 contains several targets 32*a*, 33*a* each having a main axis of symmetry whereas support 41 contains several filters 34*a*, 35*a* each having a main axis of symmetry. The positioning means (stops 20*c*) with which supports 40 and 41 cooperate allow the axis of symmetry of any filter and the axis of symmetry of any target to be aligned with the main axis 14 of the accelerator. With respect to the embodiment shown in FIG. 4, the number of target-filter combinations is doubled with the same number of targets and filters.

Depending on the beam characteristics desired, the filter may be made from different materials, more especially tungsten, lead, copper, titanium, stainless steel or graphite. In the examples which have just been described, the supports are drawers with rectilinear movement. As mentioned above, they are made essentially from lead but they will advantageously comprise steel slides (not shown). In the simple case, shown, the mechanical handling system may be manual. If it is desired to have more than two targets and/or filters, motor driven solutions may be adopted with remote control and servo-controlled positioning, all these handling systems being within the scope of a man skilled in the art. Positioning control may also be provided by means of microcontactors and a microprocessor logic system monitoring the state of these contactors.

Figure 6:
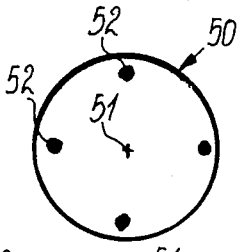
FIGS. 6 and 7 are detailed views, respectively from above and in elevation of a support according to the invention.

FIGS. 5 and 6 illustrate another type of rotary turret mobile support 50. The axis of rotation 51 of this support is offset from axis 14 of the accelerator so that the targets and/or filters may be positioned in alignment with this axis 14. In the example, the support 50 has two stages, one comprising the targets 52 and the other the filters 53.

Figure 7:
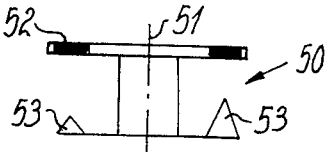
Figure 8:
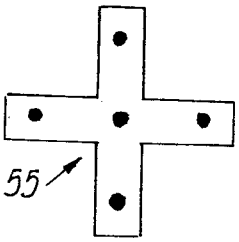
FIG. 8 is a detailed view illustrating another type of support.

FIG. 7 shows another type of possible mobile support having a general cross shape 55. This support is servo-controlled for movement in a double slide system (not shown) defining two rectilinear and perpendicular directions of movement. The cross may thus support up to five targets and/or filters.

The determination of the dimensions of the targets and filters as well as the choice of the materials used will be most often determined experimentally. By way of example, with reference to FIG. 1, and considering an incident beam of electrons of about 4 MeV, the curve A or "cobalt curve" may be obtained by using a flat tungsten target, 2 mm in thickness and a conical filter with a height of 12 mm and a base diameter of 25 mm. Curve B may be obtained by using a target comprising a 1 mm layer of tungsten and a 1 mm layer of copper as well as a stainless steel conical filter with a height of 16 mm and a base diameter of 25 mm.

What is claimed is:

1. In a multioperation accelerator for radiotherapy of the particle beam type comprising a target bombarded by said particle beam for generating a photon beam, the HF supply power of said accelerator is fixed once and for all at a predetermined level and it comprises several switchable targets at the output of said accelerator, allowing a predetermined number of target-filter combinations to be selectively moved by mechanical switch means into the particle beam to produce photon beams with different chosen characteristics with the penetration curve of the photon beams being modified by the distribution of the energy of the photons below an upper limit without modifying the upper limit, which are varied only with the selection of the target and filter, said targets and filters being stationary during the operation of the device.

2. The multioperation accelerator as claimed in claim 1, further comprising a mobile support containing several targets each having a main axis of symmetry, the path of said support passing in front of the output of said accelerator and positioning means being provided for aligning any target axis with the main axis of the accelerator.

3. The multioperation accelerator as claimed in claim 1, comprising a single fixed target disposed at the output of said accelerator and centered on its main axis, a mobile support containing several filters each having a main axis of symmetry, the path of said support passing in front of said target and in the vicinity thereof and positioning means being provided for aligning the axis of any filter with the main axis of the accelerator.

4. The multioperation accelerator as claimed in claim 1, comprising a mobile support containing several targets and several filters fixed respectively in twos facing each other so that a main axis of symmetry of each target merges with a main axis of symmetry of the corresponding filter, positioning means being provided for aligning any of these axes with the main axis of the accelerator.

5. The multioperation accelerator as claimed in claim 1, comprising a mobile support containing several targets each having a main axis of symmetry and a mobile support containing several filters each having a main axis of symmetry, positioning means being provided for aligning the axis of symmetry of any filter and the axis of symmetry of any target with the main axis of the accelerator.

6. The accelerator as claimed in one of claims 2 to 5, wherein said support comprises cavities each housing a filter and/or a target.

7. The accelerator as claimed in one of claims 2 to 5, wherein said support made essentielly form lead and comprises cavities each housing a filter and/or a target.

8. The accelerator as claimed in claim 2, wherein each said mobile support or supports is in the form of a drawar with rectilinear movement.

9. The accelerator as claimed in claim 1, wherein each of said mobile supports is in the form of a rotary turret.

10. The accelerator as claimed in claim 2, wherein each of said mobile supports is in the general form of a cross with two slides having two perpendicular rectilinear directions of movement.

11. The accelerator as claimed in claim 1, wherein the filters are made from a material chosen from the group consisting of tungsten, lead, copper, titanium, stainless steel and graphite.

12. The accelerator as claimed in claim 1, wherein at least one filter has a pyramidal or conical shape, known per se.

13. The accelerator as claimed in one of claims 2, 4 or 5, wherein said targets are made of different materials.

14. The accelerator as claimed in one of claims 3 4 or 5, wherein said filters are made of different materials.

* * * * *